United States Patent [19]

Browning, Jr.

[11] Patent Number: 4,860,515

[45] Date of Patent: Aug. 29, 1989

[54] SELF-SUPPORTING CONCRETE FORM

[76] Inventor: Bruce E. Browning, Jr., P.O. Box 56, Carrboro, N.C. 27510

[21] Appl. No.: 54,430

[22] Filed: May 26, 1987

[51] Int. Cl.[4] ..... E04B 2/40

[52] U.S. Cl. ..... 52/426; 52/422; 52/432; 52/439

[58] Field of Search ..... 52/426, 422, 425, 424, 52/437, 439, 604, 432; 249/27, 33

[56] References Cited

U.S. PATENT DOCUMENTS

| | | | |
|---|---|---|---|
| 903,734 | 11/1908 | Larsen . | |
| 953,722 | 4/1910 | Taylor | 249/27 |
| 1,064,056 | 6/1913 | De Rehbinder | 52/424 |
| 1,154,546 | 9/1915 | Peters . | |
| 1,175,044 | 3/1916 | Braun | 249/27 |
| 1,958,771 | 5/1934 | Simons | 72/30 |
| 2,290,339 | 7/1942 | Leach | 25/121 |
| 2,647,392 | 8/1953 | Wilson | 72/44 |
| 2,940,294 | 6/1960 | Carlson | 52/437 |
| 3,255,562 | 6/1966 | Altschuler | 52/309 |
| 3,292,331 | 12/1966 | Sams | 52/405 |
| 3,410,044 | 11/1968 | Moog | 52/309 |
| 3,449,878 | 6/1969 | Hern | 52/293 |
| 3,552,076 | 1/1971 | Gregori | 52/309 |
| 3,788,020 | 1/1974 | Gregori | 52/309 |
| 4,223,501 | 9/1980 | DeLozier | 52/426 |
| 4,516,372 | 5/1985 | Grutsch | 52/426 |

FOREIGN PATENT DOCUMENTS

| | | | |
|---|---|---|---|
| 987167 | 12/1951 | France | 1/7 |
| 1112088 | 11/1955 | France | 52/424 |
| 664514 | 1/1952 | United Kingdom . | |
| 1202871 | 8/1970 | United Kingdom | 52/422 |

*Primary Examiner*—Michael Safavi

*Attorney, Agent, or Firm*—Dority & Manning

[57] ABSTRACT

An approved self-supporting form for use in constructing walls is adapted to be reinforced with cementitious materials poured therein, while securely supporting additional building materials on the outside thereof. The walls of the forms themselves are generally comprised of resilient, insulating materials, such as foamed plastics or the like. An anchored securement member is embedded in the concrete interiorly cured in the forms, and also extends to the exterior of the forms, where it is adapted for receipt of conventional attachment elements such as nails or screws. A plurality of the forms may be used to construct walls, much like conventional building blocks. Then, finishing cladding materials such as panelling, wallboard, or the like may be safely secured to the exterior of the forms with such attachment elements, even if the actual foamed sidewalls of such forms become damaged by heat or the like.

6 Claims, 4 Drawing Sheets

SELF-SUPPORTING CONCRETE FORM

BACKGROUND OF THE INVENTION

This invention concerns in general a self-supporting form adapted for use in construction, and in particular a self-supporting, self-insulated form having internal cavities adapted for receipt of cementitious materials to be poured and cured in such cavities while supporting additional building materials on the outside of the forms. A plurality of such forms may be used together to form a wall, with at least one side of such wall being adapted for the attachment of additional materials (such as wallboard or panelling) thereto, with anchored attachment members therefor extending between such wall exterior and the interiorly received and cured cementitious material.

In general, advantages of using modular building blocks comprising foamed or plastic materials are known. Forms made of such material are typically structured for strength adequate to provide self-supporting forms for the pouring of cementitious materials, such as concrete or the like, therein. Once the concrete is cured, the forms may be left in place as insulation. Also, the insulation of such forms provide conditions for curing of concrete poured therein which are improved over those of other conventional forms, such as wooden forms which must be custom built on location and subsequently stripped from the cured concrete.

The following are examples of United States Patents disclosing various building blocks comprising plastic or foamed materials:

| U.S. PAT. NO. | INVENTOR(S) | DATE OF ISSUE |
|---|---|---|
| 2,647,392 | Wilson | August, 1953 |
| 3,255,562 | Altschuler | June, 1966 |
| 3,292,331 | Sams | December, 1966 |
| 3,410,044 | Moog | November, 1968 |
| 3,449,878 | Hern | June, 1969 |

While such blocks generally provide improved concrete-reinforced walls (for some of the reasons stated above), they are not particularly adapted for supporting additional materials, such as panelling, wallboard, or the like, thereon. For example, wallboard or paneling could be glued onto an exterior surface of the blocks, but such procedure can be time consuming, and fall out of the mainstream of building practices and materials used by ordinary artisans. Accordingly, specialized laborers, as well as additional time and materials would be required.

Alternatively, if one attempted to nail such wall cladding materials to such blocks, there would be great uncertainty as to the proper placement and size selection of the nails to ensure securement of the cladding materials. Additionally, many insulating materials are relatively resilient; hence, attempting to nail directly to a wall comprising such materials could literally cause damage to the wall itself.

Some known insulated forms for concrete have addressed the general problem of securing cladding materials to a wall formed by such forms. For example, two United States Patents by Gregori (U.S. Pat. Nos. 3,788,020 and 3,552,076), both of which are incorporated here by reference, provide dovetail grooves formed horizontally in the exterior of building block sidewalls so as to form plaster keys to facilitate application of a plaster wall thereto. However, such securement means fails to particularly accommodate any other type of cladding materials other than plaster, such as panelling or wallboard which is conventionally nailed into place.

Even in certain circumstances, the Gregori plaster key grooves can fail to prove satisfactory for retaining plaster. For example, it may prove difficult during formation of plaster walls to ensure proper filling of the upper edge in the dovetail groove. Hence, over time the plaster wall under its own weight may tend to pull away from the poured concrete wall. Such pull away is most likely to occur, and be highly dangerous, during a fire. Heat from the fire can melt the foamed material of the concrete form long before any damage occurs to the interior concrete wall itself. Such melting causes an obvious loss of grip at such plaster keys. Thus, if a wall becomes heated due to a fire, or even from the heat of an adjacent fireplace, it is possible for finished walls secured with such plaster keys of the Gregori blocks to suddenly fall down and collapse on occupants of the room, or cause other damage.

SUMMARY OF THE PRESENT INVENTION

The present invention recognizes and addresses such drawbacks and disadvantages of previous devices. Accordingly, it is a general object of this invention to provide an improved self-supporting concrete form which is particularly adapted for the safe securement of additional building materials (such as panelling, siding, wallboard or the like) to the exterior of such forms.

It is a more particular object of the present invention to provide an improved self-supporting concrete form wherein additional building materials may be anchored thereto with conventional construction techniques, such as the hammering of a nail or the introduction of a screw thereinto.

It is yet another object of this invention to provide such an improved building block which permits additional building materials secured thereto to be anchored in cementitious materials poured and cured in the form, whereby such added building materials may be safely secured to a wall constructed with forms produced in accordance with the present invention even should heat or some other condition cause damage to the walls of the forms themselves.

It is yet another object of this invention to provide such an improved building block, but which also may be used generally in the construction of a wall (much like a conventional concrete building block) to build different types of walls, such as straight walls or right-angle construction walls.

These and other objects and advantages of the present invention are accomplished in accordance with presently disclosed features, various combinations of which features and aspects of this invention may provide different exemplary embodiments thereof. One such exemplary combination of present features in accordance with this invention is directed to a self-supporting form for use in construction with cementitious materials, such form comprising: a generally regularly-shaped body of insulating material, such body including at least two opposing sidewalls each having exterior and interior sides with respect to such body, and such sidewalls mutually defining at least one cavity therebetween adapted for the receipt of cementitious materials; and securement means, operatively associated with the cavity and at least one of the sidewalls, adapted for enabling securement of cladding materials to the exterior side of the at least one sidewall with such securement being anchored in cementitious materials received in the cavity, whereby a desired finishing surface of selected cladding materials may be securely applied to a construction formed with a plurality of the forms and reinforced with cementitious materials received in the cavities thereof.

Another exemplary embodiment in accordance with the present invention concerns a self-supporting, self-insulating form for pouring concrete therein and supporting finishing wall materials thereon, comprising: two opposing sidewalls of low density polymeric material, each sidewall having a substantially planar exterior side and matable edging members adapted for aligned engagement of adjacent like forms, the opposing sidewalls further mutually defining at least one cavity therebetween adapted for the receipt of concrete, with one of the sidewalls defining an opening therein interconnecting such cavity with the exterior side of the one sidewall; two spaced end walls generally transverse to the sidewalls and respectively interconnecting same; a finishing material attachment element received in the opening and extending into the cavity so as to be anchored therein by concrete subsequently poured and cured about the element and within the cavity, wherein the attachment element is adapted to receive a fastening element such as a nail or screw therein for fastening finishing wall materials such as wallboard or paneling to the exterior of a plurality of the forms adjacently engaged in aligned arrangement with concrete poured and cured in the cavities thereof, whereby an improved concrete-reinforced self-insulated finished wall may be provided.

Still another exemplary embodiment of the present invention includes a wall structure for poured concrete, comprising a plurality of molded low-density building blocks, each block having at least two opposing sidewalls with at least two transverse end walls interconnecting same so that the blocks when stacked define a plurality of internal vertical cavities integrally interconnected by internal horizontal cavities whenever the cavities are filled with concrete, at least some of the blocks having anchored securement members extending through the sidewalls thereof and into some of the cavities so as to be embedded within concrete poured therein while also extending to the exterior of the blocks, whereby additional building materials may be secured to such block exteriors, despite any sidewall failure of the blocks, by attachment of the additional materials to the anchored securement members.

While exemplary embodiments of this invention are discussed in specifics throughout the present specification, it is to be understood that those of ordinary skill in the art will recognize and practice various alternatives, modifications and the like of the present exemplary features and aspects of this invention, all of which variations are intended to come within the spirit and scope of the present invention by virtue of present reference thereto.

BRIEF DESCRIPTION OF THE DRAWINGS

An enabling description of an exemplary embodiment of the present invention, including the best mode thereof, is set forth more particularly in the following specification with reference to the attached drawings, in which.

Like use of the same reference characters throughout the present specification and accompanying drawings is intended to represent same or like elements or features of this invention.

DETAILED DESCRIPTION OF THE PREFERRED EMBODIMENTS

Figure 1:
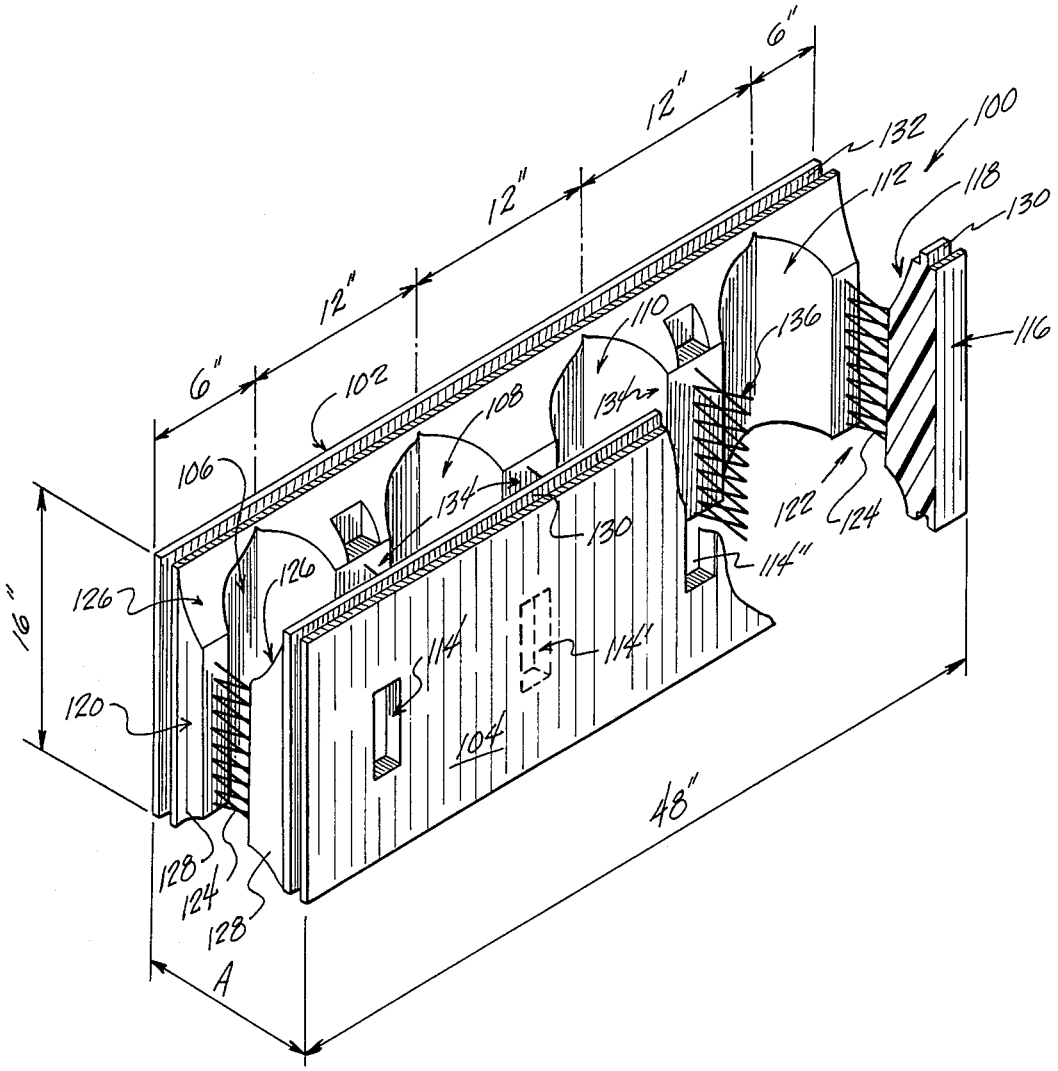
FIG. 1 is a perspective view, with partial cut away, of a single form or building block in accordance with the present invention.

FIG. 1 illustrates an exemplary form or building block 100 in accordance with the present invention. Block 100 is generally comprised of insulating materials (such as foamed plastics) forming at least two opposing sidewalls 102 and 104. Such sidewalls define at least one interior cavity 106 therebetween. In this instance, and hereinafter, the term interior generally refers to anything which is located between the mutually opposing sidewalls 102 and 104.

Preferably, the opposing sidewalls of block 100 define a plurality of parallel-aligned cavities 106, 108, 110, and 112 therebetween. During use, block 100 is preferably disposed with such cavities 106 through 112 in a substantially vertical orientation. Such vertical cavities are generally tubular in nature, and substantially cylindrical even though a slight draft may as a practical matter be formed therein in one direction or the other merely for the convenience of forming block 100 whenever molding techniques are used for such formation.

In its preferred forms the present invention is intended to facilitate use thereof with conventional building techniques. Accordingly, the exemplary embodiment of FIG. 1 includes thereon dimensional characteristics such that the four substantially cylindrical vertical cavities thereof are placed on 12 inch centers from one to another. As will be seen hereinafter, such positioning relates to securement means provided by this invention. In one exemplary embodiment, such securement means includes in part at least one opening 114 defined in at least one of the sidewalls of block 100.

Sidewall 104 includes an exterior side 116 (i.e. generally exterior to block 100) and an interior side 118 (i.e. generally interior to block 100). The mutually facing interior sides of both sidewalls of block 100 define the above-mentioned vertical cavities therein. Opening 114 preferably interconnects exterior side 116 of sidewall 104 and one of the cavities formed within block 100 by interior side 118 of sidewall 104 cooperating with the other interior side of sidewall 102. Additional aspects of securement means in accordance with the present invention will be discussed further below with respect to the remaining figures.

Though not shown interior side 118 of sidewall 104 preferably has substantially the same shape as the illustrated interior side of sidewall 102 (seen with the aid of the partial cutaway of sidewall 104), and therefore serves to further define the preferably tubular and substantially cylindrical nature of the vertical cavities. As better illustrated in FIG. 3 below, attachment means openings (such as 114) defined in sidewalls of the present invention preferably oppose the widest diameter portions of the vertical cavities. Other features of foam block 100 are as follows.

Opposing sidewalls 102 and 104 are generally joined by spaced end walls 120 and 122. Such end walls may comprise (at least in part) integrally formed portions of the sidewall insulating material, such as expanded polystyrene or other insulating materials. The above-mentioned U. S. Patents to Gregori are herein incorporated by reference, particularly with respect to the selection and formation of insulating materials. Such end walls may also be partly formed with other materials such as wire mesh members 124. Such wire mesh generally establishes a fire break between sidewalls 102 and 104.

In addition to the exemplary vertical cavities defined in block 100, horizontal cavities are defined which interconnect such vertical cavities once concrete or other cementitious type materials are poured and cured between the opposing sidewalls of block 100. For example, curved faces 126 and 128 are generally defined along the length of block 100, and serve to form the horizontal cavities which interconnect the respective vertical cavities once cement or the like is poured and cured within block 100. It may be noted from FIG. 1 that each of the curved surfaces 126 and 128 generally define a semi-circular region which may cooperate with a like semi-circular region respectively above or below same whenever a plurality of such blocks 100 are stacked together in known construction techniques for building a wall.

The peripheral edges of each sidewall may be provided with various mateable features, such as tongue and groove elements, for permitting adjacent alignment of like building blocks. For example, a tongue feature 130 of FIG. 1 may be mated with a groove feature 132; of course, such tongue and groove mating occurs between adjacent blocks only, either in side to side or top to bottom relationship.

Interior walls 134, similar to ends walls 120 and 122, may be variously provided for furthering definition of vertical cavities within block 100. Such interior walls 134 are defined by the interior sides of the respective sidewalls, much like end walls 120 and 122, and also may variously compose portions of expanded polystyrene or similar insulating materials integrally formed with such sidewalls, and interconnecting wire mesh elements such as 136. Such interior walls also serve to add strength to block 100. The ends of wire mesh elements 124 and 136 may be bent or otherwise secured within their respective end or interior walls, so as to prevent separation of sidewalls 102 and 104 from their preselected separation distance "A" (exterior side to exterior side). Width A may vary, but typically falls in a range of about nine to about eleven inches (with corresponding interior core widths of six and eight inches, respectively).

FIG. 1 illustrates sidewall 104 thereof with a partial cutaway so that the interior structure thereof may be better understood. In particular, one attachment means opening 114'' thereof is only partially illustrated, while a pair of openings 214 of FIG. 2, corresponding with openings 114 and 114'' of FIG. 1, are illustrated in full. An additional opening 114' is illustrated in dotted line in FIG. 1, and represents an optional placement of attachment means openings on 12 inch centers (as opposed to 24 inch centers), with such opening 114' being disposed substantially opposite the greatest diameter portion of a vertical cavity 108.

Alternative placements and numbers of attachment mean openings, as well as vertical cavities, may be practiced in accordance with the present invention. For example, an additional opening 114' may be used opposite the greatest diameter portion of vertical cavity 112, which would fall within the area of sidewall 104 which is cut away for purposes of convenience in the illustration of FIG. 1. Also, the attachment means in accordance with the present invention, more fully described below with reference to FIG. 3, may be practiced with either one or both sidewalls of a given block. In its broadest terms, at least one attachment means in accordance with the present invention is ordinarily used with at least one sidewall of some of the blocks used to form a wall in accordance with the present invention.

Figure 2:
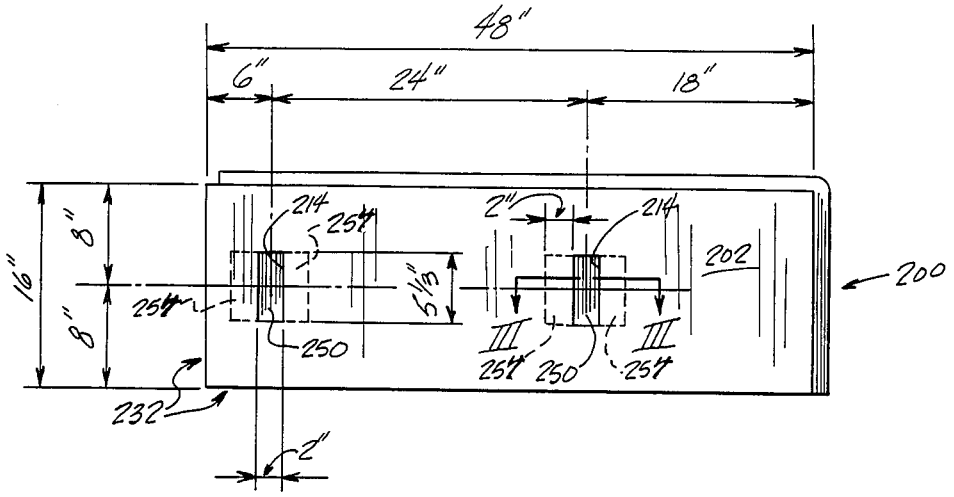
FIG. 2 is a side plan view of a block similar to the one shown in FIG. 1.

Referring now to FIG. 2, a side plan view of an exemplary building block 200, similar to that of block 100 in FIG. 1, is illustrated. Since a substantially side view is illustrated, only one sidewall 202 is seen. Block 200 is about 48 inches long and 16 inches tall so that attachment securement means in accordance with the present invention may be provided on 24 inch centers, as illustrated. Openings 214 of sidewall 202 are illustrated with such 24 inch spacing, and include an additional member 250 residing therein. Such member in this embodiment includes foldable wing portions 254 preferably extending on either side of openings 214, all of which is more specifically discussed with reference to FIG. 3 below. Such wing members 254 are illustrated in dotted line in FIG. 2 since they are interior to block 200 (i.e. behind sidewall 202 as illustrated in present FIG. 2).

Sidewall 202 is illustrated as having a tongue member 230 integrally formed with such sidewall along the top and right hand edges thereof, while a groove member 232 (not seen in the view of FIG. 2) may be used along the bottom and left hand edges of such block 200. The dimensional characteristics illustrated in connection with present FIG. 2 are for purposes of that exemplary embodiment only, and the broader aspects of the present invention are not limited to such specific dimensions. Alternative embodiments enlarged or made smaller in ratio to such measurements, or disproportionately to such measurements, may be practiced by those of ordinary skill in the art without departing from the spirit and scope of this invention.

Figure 3:
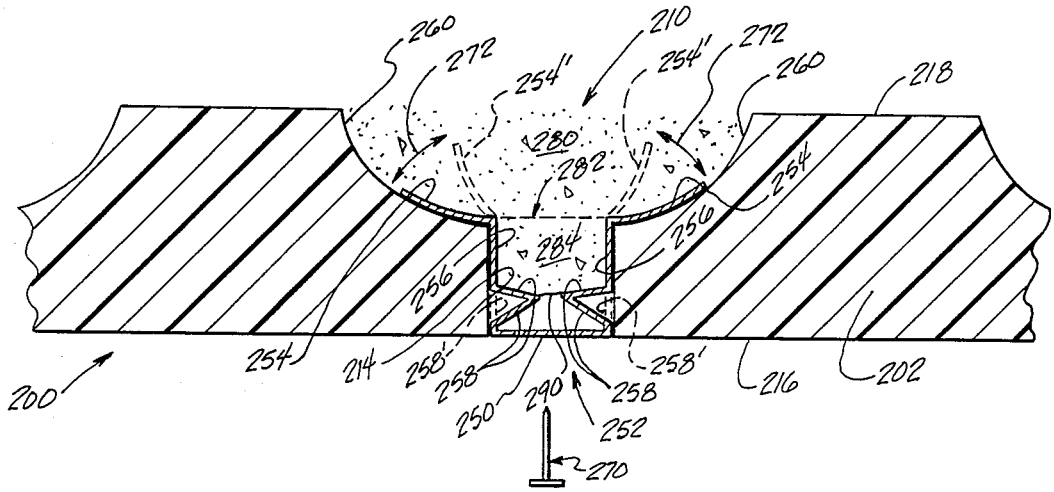
FIG. 3 is a partial cross-section of a securement means feature of this invention as practiced with the exemplary block illustrated in FIG. 2, taken along the cross-sectional lines indicated therein.

FIG. 3 illustrates a cross-section of a particular area of sidewall 202 of present FIG. 2 embodying the attachment means thereof, as taken along the line III—III shown in present FIG. 2. Opening 214 defined in sidewall 202 interconnects an interior vertical cavity 210 with exterior surface 216 of sidewall 202. Since the interior curvature 260 defining vertical cavity 210 actually forms part of the features defined by interior side 218, opening 214 may also be viewed as interconnecting the exterior and interior sides of sidewalls 202.

As discussed above, the sidewalls of block 200 preferably comprise insulating-type material. Such material is generally resilient. Insert member 250 may comprise a number of materials which are different from that forming such resilient sidewalls, but preferably comprises a metallic member such as the stamped metal piece illustrated in FIG. 4 (discussed below). An attachment portion 252 essentially defines an attachment surface adapted for receipt of an attachment member 270, such as a nail, screw, or the like.

As understood by those of ordinary skill in the art, the void formed by vertical cavity 210 is preferably filled with cementitious material 280, such as cement or the like, which cement 280 may extend beyond an optional barrier 282 (when such barrier is omitted) so as to reside in and fill the area 284 substantially defined by opening 214 behind attachment surface 252 of the relatively rigid material member 250.

Such relatively rigid material member 250 further includes foldable wing members 254 which as illustrated by double-headed arrows 272, are selectively movable to dotted-line positions 254' of such wings 254. Such alternative positions for wings 254 are preferably assumed prior to the pouring and curing of concrete 280 within vertical cavity 210. Prior to such pouring, wings 254 are folded in adjacent to interior curved portions 260 of cavity 210, for the convenience of placement and securement of member 250 within block 200. As readily understood by those of ordinary skill in the art, winged members 254 become embedded within cured concrete 280 by folding same outward to positions 254' thereof before pouring and curing of such concrete. Wings 254 would to some extent also be held by concrete 280 even if they were left in their indicated solid-line positions adjacent curved interior surfaces 260.

Preferably, wings 254 are securely attached to or integrally formed with attachment portion 252 of member 250, by side connections 256 thereof. Such side connections are preferably integrally formed with respective wing members 254 and attachment portion 252. As illustrated by solid line members 256 in FIG. 3, various folded members 258 of securement member 250 serve to define one side of the area 284 behind attachment portion 252. When such folded side connections are used, a barrier 290 is substantially formed by the opposing apex portions of the respective folded members 258. Such barrier 290 cooperates with the illustrated folded members 258 and the planar attachment member 252 to define a non-cement filling void 292 therebetween. In such configuration, an attachment element 270 may be seated in attachment portion 252 and passed only through portion 252 and into such void 292. Such arrangement permits the attachment element 270 to be preferably received in only the metallic attachment portion, without also having to penetrate various cementitious type materials.

Alternatively, side members 256 may use straight (instead of folded) wall portions 258' (illustrated in dotted line) all the way through and along the sidewalls of opening 214, thereby omitting barrier 290. Whenever barrier 282 is also not present, such straight sidewall configuration 258' permits cementitious materials 280 to also fill areas 284 and void 292 so that any attachment element 270 seated in and passing through attachment portion 252 of element 250 may also (as sometimes desired) be seated in the cured cementitious type materials themselves.

Further alternatively, without respect to the presence or absence of barrier 290 (i.e. use of sidewalls 258 or 258'), barrier 282 may be used situated as shown in dotted line so that an attachment element 270 will need only penetrate attachment portion 252 (with area 284 being retained as a void), provided that attachment element 270 is shorter than the combined side length of opening 214. If further desired, attachment element 270 (particularly when embodied as a screw) may be received within a (threaded) opening passing through barrier 290.

Regardless of the particular embodiment practiced in accordance with the present invention, member 250 (comprised of relatively rigid material) in any event provides an anchored securement member, anchored in concrete poured within at least one of the interior cavities of block 200, and further securely receiving attachment element 270. Though not specifically illustrated, those of ordinary skill in the art understand that additional building materials, such as finishing materials like wallboard, panelling, or the like may be secured to attachment portion 252 by attachment element 270. Of course, other building materials, such as intermediate materials (sound proofing, additional insulation, etc.) may be similarly secured. In such event, the added construction materials are advantageously secured to a wall formed with a plurality of blocks 200 by relatively conventional construction techniques (nails, screws or the like), while ensuring that degradation of sidewall 202 by heat or the like will not cause any loosening of the attachment between element 270 and block 200 (specifically, the concrete received and cured in cavity 210 thereof).

Figure 4:
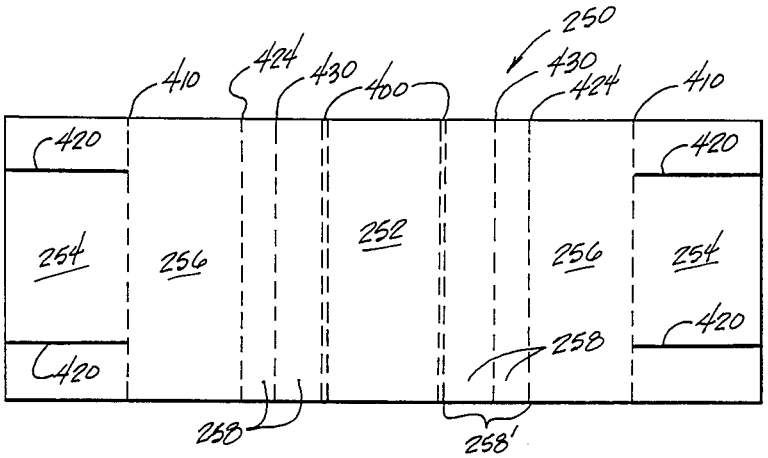
FIG. 4 illustrates a foldable securement member to be anchored within the present form in providing securement means thereof in accordance with this invention, particularly as illustrated in present FIG. 3.

FIG. 4 illustrates a preferred embodiment of a securement member 250, prior to folding and insertion (including anchoring) thereof within a block in accordance with the present invention, as illustrated in present FIG. 3. In FIG. 4, dotted lines generally indicate fold lines of such relatively rigid material member 250, while solid lines indicate cuts therein at which various sections thereof are separated. Fold lines 400 generally define therebetween the attachment portion 252, which faces outward from opening 214, and is adapted for receipt of an attachment element 270 therein.

Wing members 254 are respectively formed on the two outer portions of member 250 as illustrated, although a single wing member could be utilized instead. Fold lines 410 are placed from fold lines 400 a distance equivalent to the depth of opening 214. Thus, with fold line 400 received adjacent the exterior side of sidewall 214 (as in present FIG. 3), the fold lines 410 are relatively adjacent interior side 218 of sidewall 202 (specifically curved areas 260 thereof). Cut lines 420 may be optionally used so that only a portion of each end panel is provided as a foldable wing 254. Alternative shapes and configurations may be practiced.

In between the respective fold lines 400 and 410 are additional fold lines 424 and 430, which are used whenever folded members 258 are used. Fold lines 430 correspond with the apex portions of folded members 258 which form the barrier 290 therebetween (see FIG. 3). Fold lines 424 and 430 may be omitted whenever straight wall members 258' are to be used. In such instance, the dimensions of a given member 250 obviously require adjustment for use with a given size and depth opening 214.

FIG. 4 illustrates only one exemplary embodiment of a relatively rigid member for use in accordance with the present invention, and other shaped members, and members of a variety of materials, may be practiced in accordance with the present invention. Essentially, the broader requirements of member 250 is that it provide some type of attachment surface or area which facilitates attachment of additional building materials to the exterior side of block sidewalls, while also having an inwardly-projecting portion anchoring such additional materials in cementitious materials poured and cured within the interior of such block.

Figure 5:
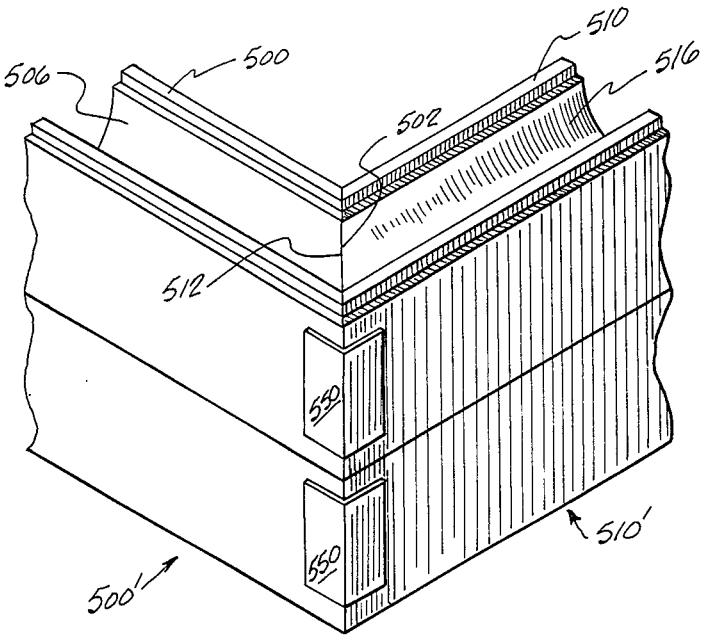
FIGS. 5 and 6 illustrate perspective and top views, respectively, of an example of right-angle wall construction using forms in accordance with the present invention.
Figure 6:
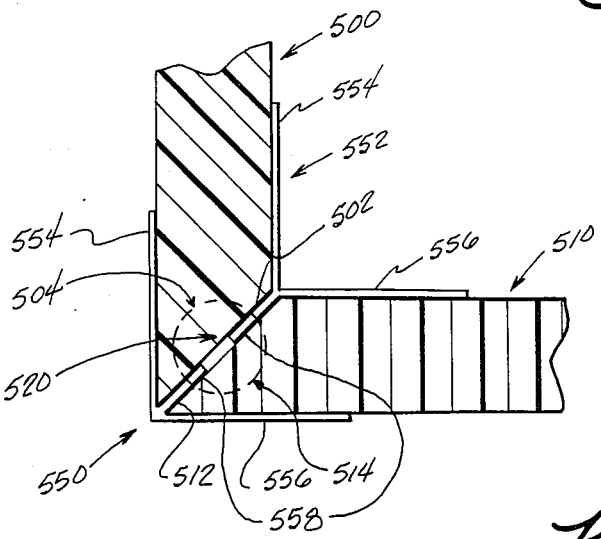

FIGS. 5 and 6 illustrate alternative attachment means in accordance with the present invention, particularly adapted for use with a right-angle construction. FIGS. 5 and 6 show in particular a perspective and top view, respectively, of a right-angled construction in accordance with the present invention, wherein a pair of blocks 500 and 510 are brought together at respective diagonal cuts 502 and 512 thereof. Such cuts may, in general, be readily formed in their respective blocks (preferably at about a 45° angle each) since such blocks chiefly comprise foamed materials. Alternative matching cuts may be practiced, including those resulting in some angle other than 90° between blocks 500 and 510 which may from time to time be desired.

The illustrations of present FIGS. 5 and 6 substantially show blocks 500 and 510 without many of the details illustrated in present FIGS. 1–4, so as to clarify presentation of the right-angle construction in accordance with this invention. Hence, portions of vertical cavities present in blocks 500 and 510 are illustrated only in FIG. 6, and therein only in dotted-line form. Specifically, a portion of a cavity 504 is illustrated in dotted line in block 500, while a portion 514 of a cavity is illustrated in dotted line in block 510. Upper surfaces 506 and 516 of FIG. 5 illustrate horizontal cavities formed in blocks 500 and 510, respectively.

When brought together at adjacent diagonal cuts 502 and 512, a collective cavity 520 is formed. In this embodiment, rigid anchored attachment members 550 and 552 may be provided on either the exterior or interior side of the right-angle construction formed by blocks 500 and 510. Each such member may be formed of material similar to that discussed with respect to rigid material member 250 of the previous figures.

Anchored securement members 550 and 552 function identically to previous member 250 in that they provide an attachment portion or surface with two respective planar members 554 and 556 each, while having an additional member 558 integral therewith which penetrates the blocks inwardly from such respective planar members. The inwardly penetrating member is embedded or anchored in cementitious materials poured within the respective forms, as with the previous anchored securement member discussed above with respect to FIGS. 1–4. The attachment faces thereof permit attachment elements such as screws or nails to be seated therein so as to affix additional building materials to the exterior of the building forms. FIG. 5 illustrates additional forms 500' and 510', which define a first or base course beneath the right-angle construction course of blocks 500 and 510, in a manner similar to general building techniques, known to those of ordinary skill in the art without further discussion. Also, refer to the Gregori U.S. patents, cited above.

Various modifications and variations to the presently illustrated and discussed embodiments may be practiced by those of ordinary skill in the art without departing from the spirit and scope of the present invention. For example, alternative placements of the attachment faces for a given anchored securement member may be practiced. Specifically, FIG. 3 illustrates an attachment surface 252 which is substantially flush with the exterior side 216 of sidewall 202, while planar attachment areas 554 and 556 are slightly elevated from the exterior side of their respective forms. Also, the size and precise shape of self-insulating forms for pouring concrete therein, and the various elements and features thereof, need not be limited to the specific details of the presently preferred exemplary embodiments, which are set forth as examples only and not intended as limiting to the present invention, which limitations appear only in the following claims.

What is claimed is:

1. A self-supporting form for use in construction with cementitious materials, said form comprising:

a generally regularly-shaped body of insulating material, said body including at least two opposing sidewalls each having exterior and interior sides with respect to said body, and said sidewalls mutually defining at least one cavity therebetween adapted for the receipt of cementitious materials; and securement means, operatively associated with said cavity and at least one of said sidewalls, adapted for enabling securement of cladding materials to the exterior side of said least one sidewall with said securement being anchored in cementitious materials received in said cavity, whereby a desired finishing surface of selected cladding materials may be securely applied to a construction formed with a plurality of said forms and reinforced with cementitious materials received in the cavities thereof; and wherein said insulating material comprises resilient low-density foamed material;

said securement means includes a member comprising relatively rigid material extending through said at least one sidewall and into said cavity so as to be embedded in said cavity when cementitious materials are poured and cured therein;

said at least one sidewall defines an opening therein interconnecting the exterior side thereof with said body cavity; and said rigid material member includes a folded metal plate at least partially received in said opening, and having at least one pivotable wing member adapted for selective positioning from an initial to a final position thereof, said pivotable member being positioned adjacent the interior side of said at least one sidewall to facilitate placement and retention of said rigid material member in said form, and intended to be subsequently pivoted to a final position which is projecting into said cavity during pouring of cementitious materials therein so as to become anchored in said cavity by curing of such materials.

2. A self-supporting form for use in construction with cementitious materials, said form comprising:

a generally regularly-shaped body of insulating material, said body including at least two opposing sidewalls each having exterior and interior sides with respect to said body, and said sidewalls mutually defining at least one cavity therebetween adapted for the receipt of cementitious materials; and securement means, operatively associated with said cavity and at least one of said sidewalls, adapted for enabling securement of cladding materials to the exterior side of said at least one sidewall with said securement being anchored in cementitious materials received in said cavity, whereby a desired finishing surface of selected cladding materials may be securely applied to a construction formed with a plurality of said forms and reinforced with cementitious materials received in the cavities thereof; wherein said sidewalls define a plurality of vertical cavities interconnectable by a horizontal beam of cementitious material whenever same is poured and cured between said sidewalls;

said securement means comprises a plurality of rigid material members, one each extending between the exterior side of said at least one sidewall and a respective vertical cavity, whereby cladding materials attached to said rigid material members are securely anchored in cementitious material cured within said vertical cavities so that such anchoring is not diminished by any subsequent damage to said insulating material; and said vertical cavities comprise a plurality of parallel substantially cylindrical chambers defined by the multiple facing interior sides of said sidewalls.

3. A self-supporting, self-insulating form for pouring concrete therein and supporting finishing wall materials thereon, comprising:

two opposing sidewalls of low density polymeric material, each sidewall having a substantially planar exterior side and matable edging members adapted for aligned engagement of adjacent like forms, said opposing sidewalls further mutually defining at least one cavity therebetween forming a void adapted for the receipt of concrete, with one of said sidewalls defining an opening therein interconnecting said cavity with the exterior side of said one sidewall;

two spaced end walls generally transverse to said sidewalls and respectively interconnecting same;

a finishing material attachment element received in said opening and extending into said cavity so as to be anchored therein by concrete subsequently poured and cured about said element and within said cavity, wherein said attachment element is adapted to receive a fastening element such as a nail or screw therein for fastening finishing wall materials such as wallboard or paneling to the exterior of a plurality of said forms adjacently engaged in aligned arrangement with concrete poured and cured in said cavities thereof, whereby an improved concrete-reinforced self-insulated finished wall may be provided; wherein said polymeric material comprises expanded polystyrene; and said attachment element comprises an integral metallic member including a pair of foldable wings for being selectively extended into said cavity for embeddment therein whenever concrete is poured and cured in said cavity, said integral metallic member further providing a fastening surface formed substantially flush with said planar exterior side of said at least one sidewall and adapted for fastening of finishing materials thereto.

4. A self-supporting form as in claim 3, including:

a plurality of said cavities defined in parallel relationship between said sidewalls, each of said cavities being generally vertically disposed during use of said form and tubular in nature with a substantially constant cross-section; and said form further defining at least one horizontal cavity substantially perpendicular to said plural vertical cavities for interconnecting same whenever concrete is poured and cured in said form between said sidewalls thereof.

5. A form as in claim 3, wherein:

said sidewalls are of a selected thickness, and define sidewall structure having faces perpendicular to said exterior sides thereof for forming said sidewall openings; and said integral metallic member includes relatively straight side extensions interconnecting said fastening surface and said foldable wings thereof, said side extensions being disposed substantially adjacent said sidewall structure faces defining said sidewall openings so as to permit concrete to fill said void defined by said cavity, whereby fastening elements situated in and penetrating said fastening surface are also directly embedded into said void-filling concrete.

6. A form as in claim 3, wherein said integral metallic member includes folded side extensions interconnecting said fastening surface and said foldable wings thereof, said folded side extensions defining a generally closed area in part of said opening behind said fastening surface, which closed area is not accessible by concrete poured within said cavity, whereby fastening elements may be introduced into and penetrate said fastening surface without having to penetrate concrete otherwise poured in said form cavity.

* * * * *